US008413632B2

(12) United States Patent
Sand

(10) Patent No.: US 8,413,632 B2
(45) Date of Patent: Apr. 9, 2013

(54) ZERO RIDGE CYLINDER BORE

(76) Inventor: Darrel Sand, Okemos, MI (US)

( * ) Notice: Subject to any disclaimer, the term of this patent is extended or adjusted under 35 U.S.C. 154(b) by 308 days.

(21) Appl. No.: 12/794,035

(22) Filed: Jun. 4, 2010

(65) Prior Publication Data

US 2010/0307443 A1 Dec. 9, 2010

Related U.S. Application Data

(60) Provisional application No. 61/184,017, filed on Jun. 4, 2009.

(51) Int. Cl.
*F02F 1/00* (2006.01)

(52) U.S. Cl. ..... 123/193.2; 123/193.3; 22/888.06; 22/888.061

(58) Field of Classification Search ..... 123/193.2, 123/193.3; 29/888.06, 888.061
See application file for complete search history.

(56) References Cited

U.S. PATENT DOCUMENTS 4,474,147 A * 10/1984 Hoopes ..... 123/193.4
4,883,030 A * 11/1989 Tanahashi et al. ..... 123/193.3
5,050,547 A * 9/1991 Takahashi ..... 123/193.2
5,806,481 A * 9/1998 Ikegaya ..... 123/193.2
6,488,000 B2 * 12/2002 Metz et al. ..... 123/193.2
7,438,037 B2 * 10/2008 Oogake et al. ..... 123/193.2
2005/0279296 A1 12/2005 Coney et al.
2008/0196686 A1 8/2008 Plohberger

* cited by examiner

*Primary Examiner* — Marguerite McMahon
*Assistant Examiner* — James Kim
(74) *Attorney, Agent, or Firm* — Young Basile Hanlon & MacFarlane P.C.

(57) ABSTRACT

A cylinder block for an internal combustion engine includes a cylinder bore with an inner wall for containing a piston. The piston carries an upper piston ring spaced below a top surface of the piston. A removed area is formed in the inner cylinder wall having a lower edge spaced from a top surface of the cylinder wall and partially defining a void space having a greater diameter than the diameter of the inner cylinder wall. The void space is arranged to receive engine combustion particles scrapped from the inner cylinder wall by the upper piston ring to prevent build up of the particles on the inner cylinder wall in the line of movement of an upper outer edge of the upper piston ring.

7 Claims, 5 Drawing Sheets

ZERO RIDGE CYLINDER BORE

This application claims priority benefit of the Jun. 4, 2009 filing date of co-pending U.S. Provisional Patent Application Ser. No. 61/184,017, for "ZERO RIDGE CYLINDER BORE", the entire contents of which are incorporated herein by reference.

BACKGROUND

The present invention relates, in general, to internal combustion engines and, more particularly, to cylinders in internal combustion engines.

Internal combustion engines have a cylinder block in which a plurality of hollow cylinder bores are formed. Pistons are reciprocally mounted within each cylinder and connected by piston rod at one end to a crank shaft so as to be driven between the typical four strokes of an internal combustion cycle. One and typically two metal piston rings are mounted on the piston to scrape carbon off the piston and cylinder wall as the piston moves upward in the cylinder to a top dead center position.

It is common for incomplete combustion of the air fuel mixture in the combustion chambers to cause carbon particles to be formed. These particles collect in the cylinder and are scraped off of the cylinder wall by the uppermost piston ring. Due to the high combustion temperatures to which the upper portion of the cylinder and the piston are exposed, the carbon particles fuse or sinter into a s solid mass forming a ridge or bulge on the upper portion of the cylinder wall typically at or just above the upper most movement position of the upper piston ring. Since the piston ring reciprocates thousands of times per minute during normal engine operation, the uppermost surface and, in particular, the sharp upper edge of the upper piston ring repeatedly and at high force levels slams into the ridge of fused carbon particles on the cylinder wall. This causes the desired sharp upper edge of the upper piston ring to grind away and gradually ground out to a small radius. This radius gradually increases over the life of the engine until the entire outer surface of the piston ring wears away. This increased wear causes the gap between the ends of the piston ring to expand which leads to increased combustion blowby past the upper piston ring.

As a consequence, a second carbon scraping piston ring is typically employed in most engine pistons to minimize the introduction of carbon particles into the engine oil.

It would be desirable to provide an engine cylinder construction which minimizes the build up of carbon particles on the cylinder wall. It would also be desirable to provide an internal combustion engine cylinder construction which minimizes the effect of carbon particle wear on the upper piston ring.

SUMMARY

A zero ridge cylinder bore is disclosed for use in a cylinder block of an internal combustion engine.

A cylinder bore has an inner wall formed in a cylinder block for containing a piston. The piston has an upper piston ring carried in spaced manner below a top surface of the piston. A removed area in the inner wall of the cylinder block forming the cylinder bores has a lower edge spaced from the top surface of the cylinder bore and partially defining a void space having a greater diameter than the inner wall of the cylinder bore. The void space is arranged to receive engine combustion particles scraped from the cylinder bore wall by the upper piston ring to prevent buildup of the engine combustion particles on the inner wall of the cylinder bore in the line of movement of an upper outer edge of the upper piston ring.

The removed area defines a recess extending from a top surface of the cylinder block into the cylinder bore to a lower recess edge. The recess can be in the form of a conical recess decreasing in diameter from the top surface of the cylinder block to the lower edge.

Alternately, the removed area can define a recess with an upper edge spaced below the top surface of the cylinder block. In this aspect, the recess is defined by upper and lower surfaces extending angularly from the inner surface of the cylinder bore to an inner surface in the cylinder block. The recess has an open end located on the inner cylinder bore wall in the cylinder block.

The lower edge of the recess of the removed area is located at least no lower from the top surface of the cylinder block than the top position of the upper piston ring when the piston is at the top dead center position of an upward stroke within the cylinder bore. This position enables the upper outer edge of the upper piston ring to move any combustion particles which may have accumulated down the inner cylinder wall into the void space of the removed area to prevent build-up of the particles on the inner cylinder wall that could lead to deterioration of the upper piston ring.

BRIEF DESCRIPTION OF THE DRAWING

The various features, advantages and other uses of the present zero ridge cylinder bore will become more apparent by referring to the following detailed description and drawing in which.

DETAILED DESCRIPTION

Figure 1:
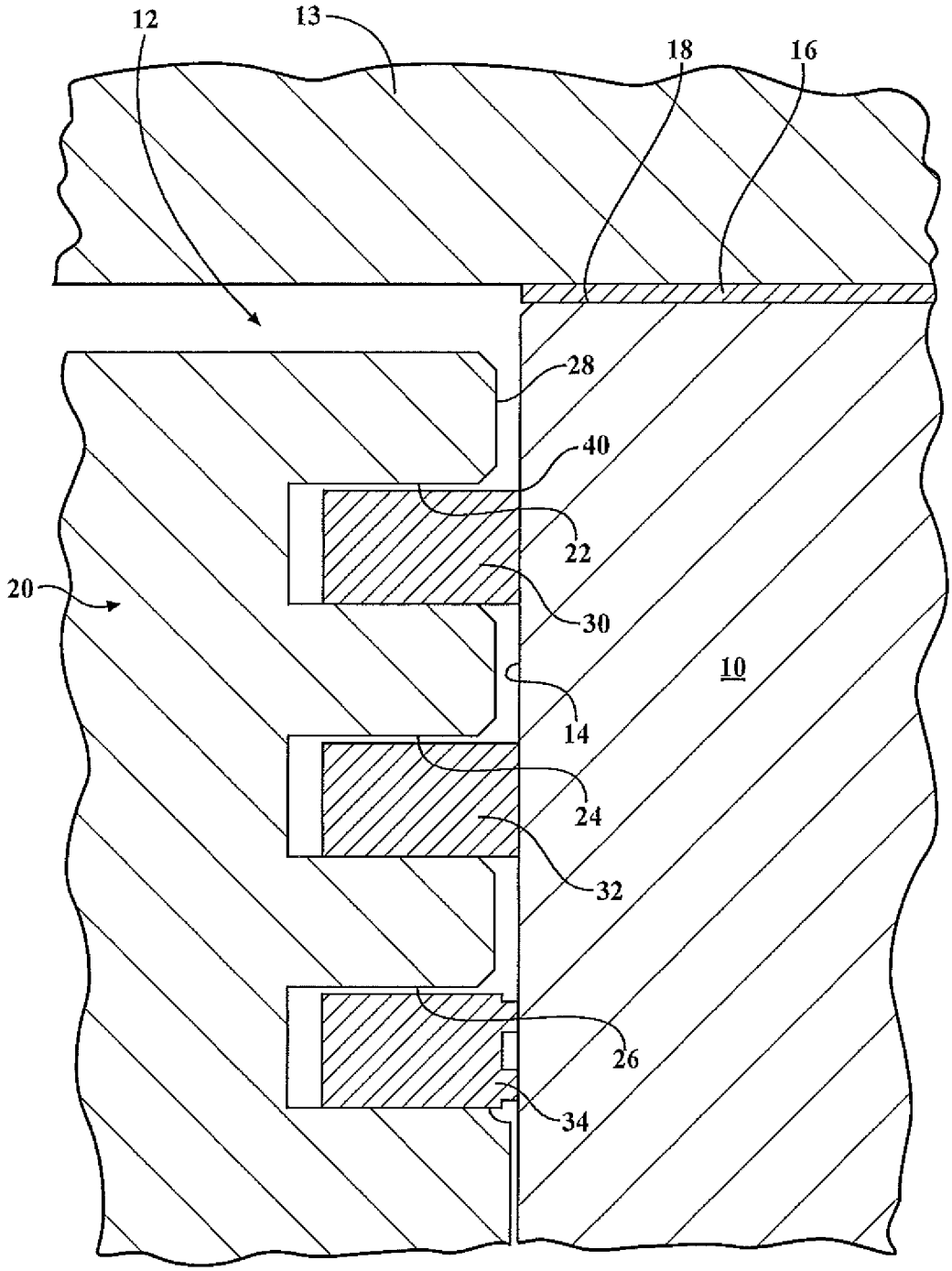
FIG. 1 Prior Art
FIG. 1 is a side elevational view of a prior art internal combustion engine block, cylinder wall, piston and piston ring configuration.
Figure 2:
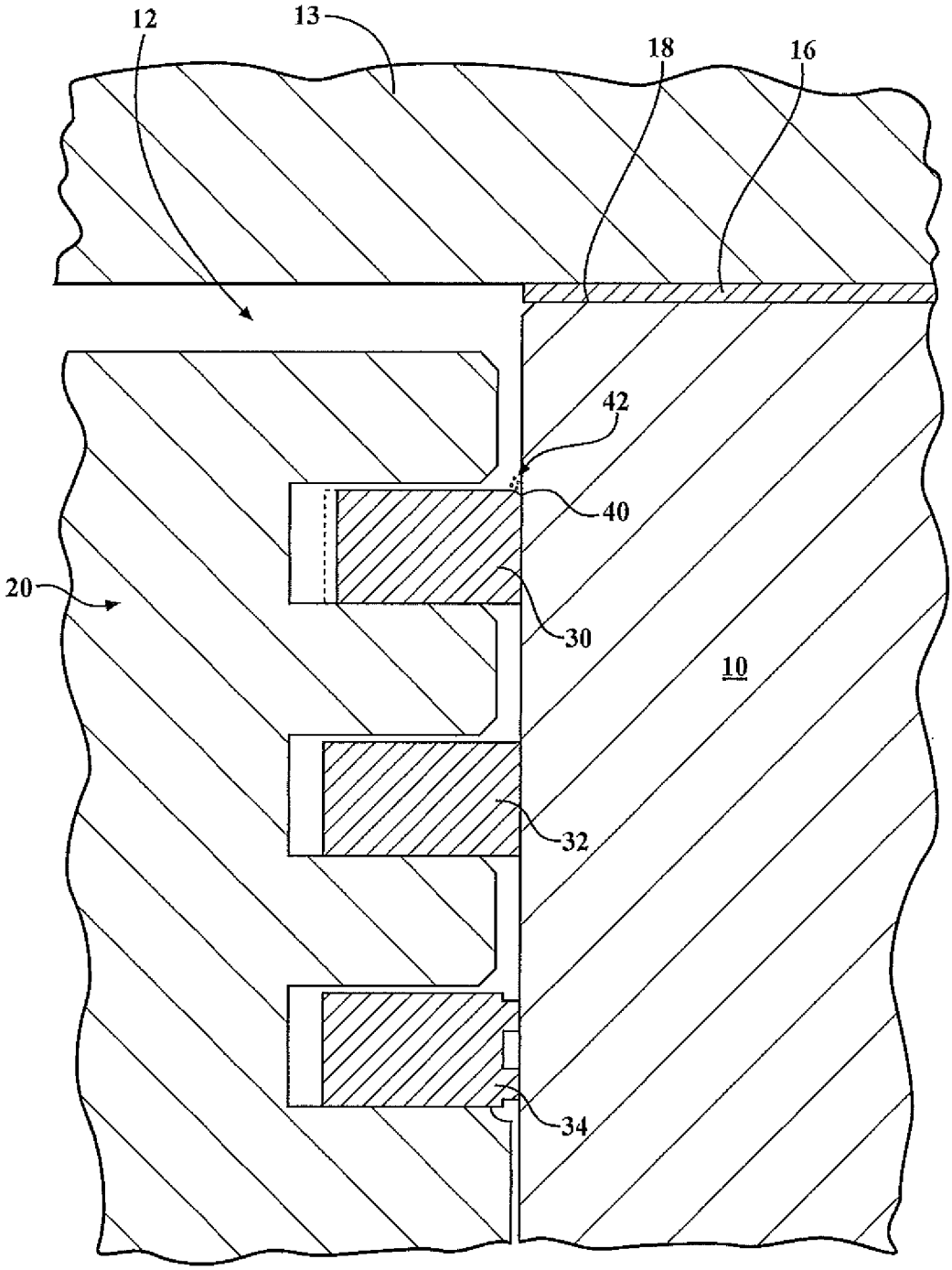
FIG. 2 Prior Art
FIG. 2 is a side elevational view, similar to FIG. 1, but showing the same prior art engine in a mid-life condition with upper piston ring wear and a build up of a carbon particle ridge on the cylinder wall.
Figure 3:
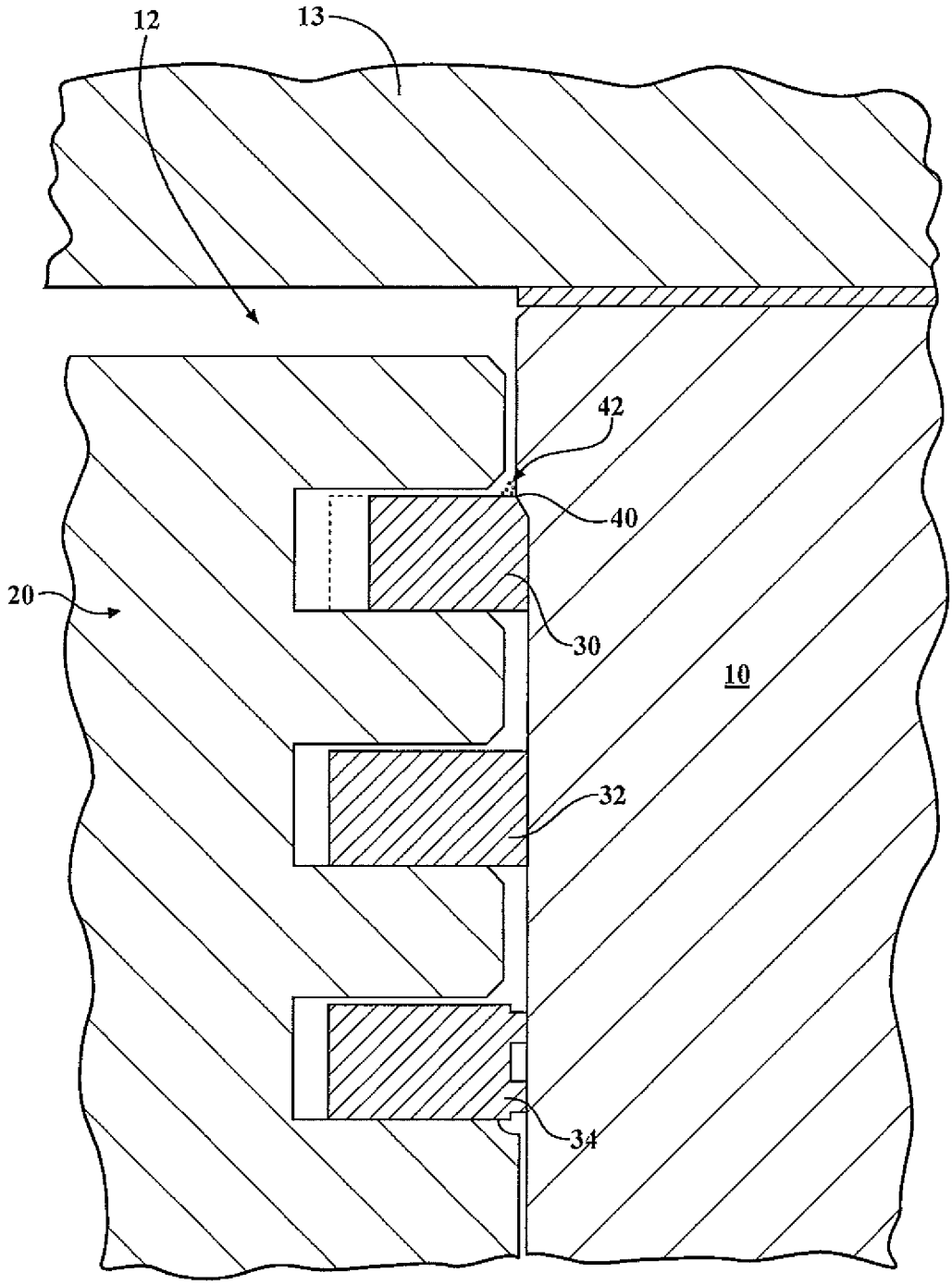
FIG. 3 Prior Art
FIG. 3 is a side elevational view, similar to FIGS. 1 and 2, but showing a late life prior art engine with extreme cylinder wall wear and rounding of the upper edge of the upper piston ring due to carbon particulate build up on the cylinder wall.

Referring to FIGS. 1, 2, and 3 there is depicted a prior art, new engine, internal combustion engine configuration consisting of a cylinder block 10 having a cylinder bore 12 extending therethrough and bounded by a cylinder wall 14. A head gasket 16 is disposed on an upper or top surface 18 of the cylinder block 10 to sealingly couple a valve head 13, to the engine block 10.

A piston 20 is reciprocally mounted within the cylinder bore 12 for movement in a normal four stroke combustion cycle in vertical up and down directions within the cylinder bore 12. At least one and typically a plurality of outer radial grooves, with three grooves 22, 24 and 26 shown by way of example only, are formed in the outer wall 28 of the piston 20.

As shown in FIG. 1, the outer wall 28 of the piston 20 is spaced a small distance away from the inner surface of the cylinder wall 14 in the cylinder bore 12. A first or upper metal piston ring 30 is mounted in the first piston ring groove 22. A second or intermediate metal piston ring 32 is mounted in the second ring groove 24. An oil scraper ring 34 is mounted in the third or lower most groove 26. The first and second piston rings 30 and 32 scrape carbon off of the cylinder wall 14 during movement of the piston 20 within the cylinder bore 12. The third oil ring 34 scrapes oil off of the cylinder wall during like reciprocating movement of the piston 20.

As shown in FIG. 1, when installed in a new engine, the upper piston ring 30 has a sharp upper outer edge 40 which engages the cylinder wall 14. After an intermediate amount of use of the engine, as shown in FIG. 2, the build up of carbon particles resulting from incomplete combustion within the combustion chamber, accumulate and form a ridge or bulge 42 on the cylinder wall 14 typically at the location of the upper edge 40 of the upper piston ring 30 as this is as far upward as the piston ring 30 moves the particles during upward movement of the piston 20 within cylinder bore 12.

Due to the heat of combustion, the carbon particles melt or sinter to form a crystal like coherent, solid mass of fused or sintered particles in the form of a solid, immovable ridge or bulge 42 on the cylinder wall 14. The repeated contact between the sharp outer edge 40 of the upper most piston ring 30 with the ridge 42 of carbon particles results in gradual wearing or smoothing away of the sharp upper edge 40 of the piston ring 30 as shown in FIG. 2. Longer engine operation causes a further wearing away of the upper edge 40 of the upper piston ring 30 as shown in FIG. 3. This rounding of the upper edge 40 leads to an enlargement of the diameter of the piston ring 30 as shown in phantom in FIG. 2. This increases the gap between the ends of the piston ring 30 and the cylinder wall 14 which leads to increased blowby of the combustion gases and carbon particles past the first ring 30 to the second piston ring 32. Further engine wear can cause the carbon particles to enter the oil which can lead to increased engined wear or the need for more frequent oil changes.

Figure 4:
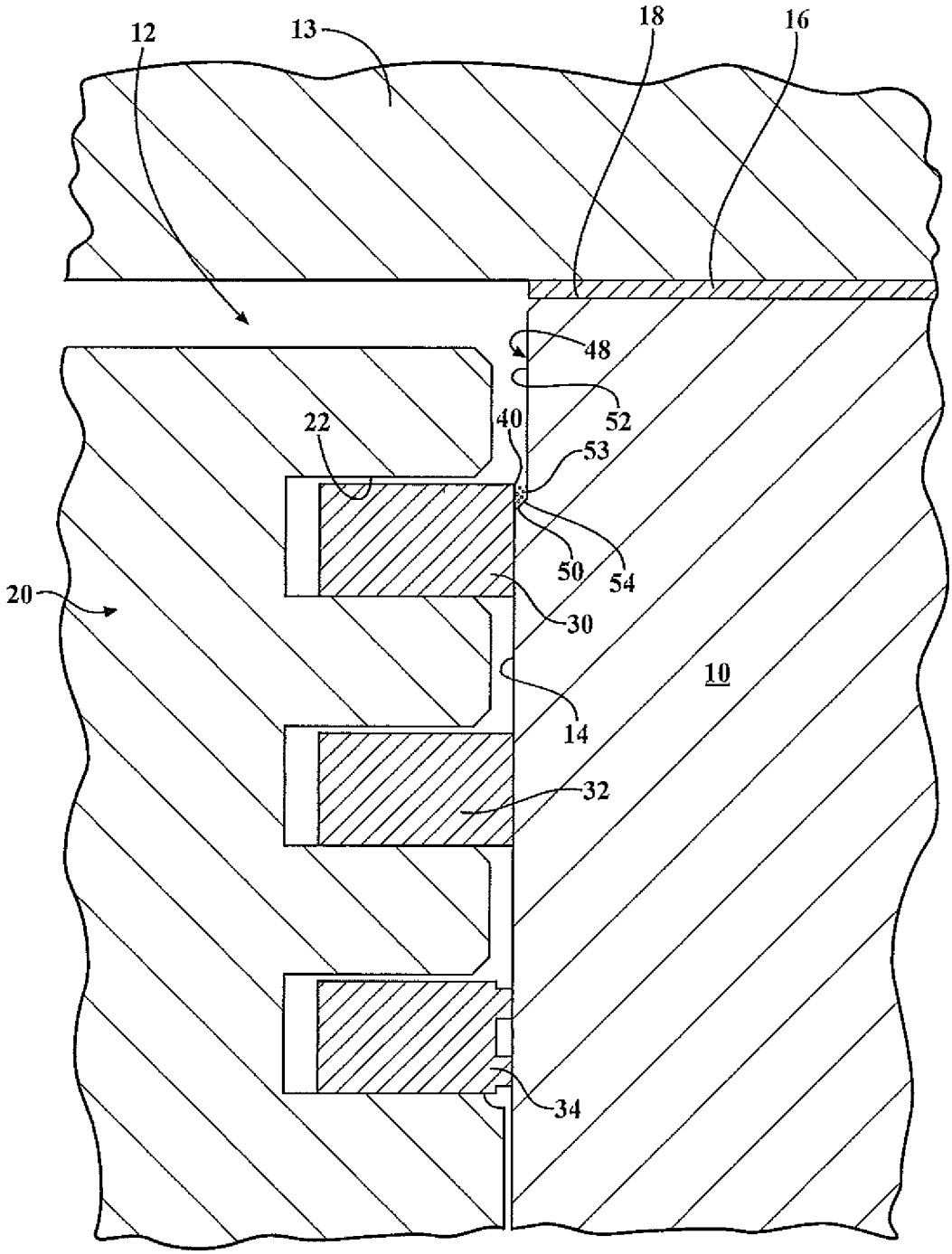
FIG. 4 is a side elevational view showing a cylinder wall recess in a zero ridge cylinder bore.
Figure 5:
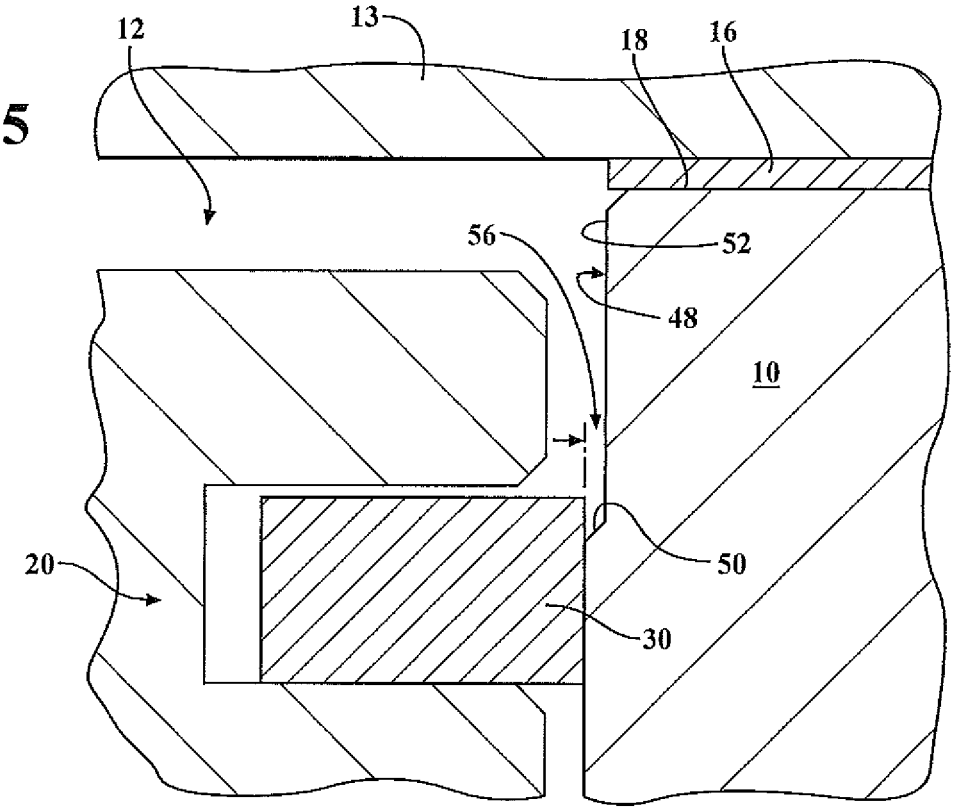
FIG. 5 is an enlarged, side elevational view showing the cylinder wall recess depicted in FIG. 4.

One aspect of a solution to this wear problem of the upper piston ring 30 is shown in FIGS. 4 and 5. In this aspect, a portion of the surface area of the cylinder wall 14 at the location where the carbon particles would typically buildup to the form the ridge 42 shown in FIGS. 2 and 3 is removed. The removed area can be a recess 48 extending from the top surface 18 of the cylinder block 14 to a lower edge 50 which is typically located below the uppermost point of movement of the outer edge 40 of the upper piston ring 30 when the piston 20 reaches a top dead center position shown in FIG. 4. The recess 48 may take any shape, such as a conical recess or a recess concentric to the cylinder wall 14 having the notched shape shown in one aspect in FIGS. 4 and 5, wherein the removed area or notch has an inner wall 52 extending from the top surface 18 of the engine block 20 to an angled lower surface 53 which transitions from the generally planar wall 52 to the lower edge 50 of the recess 48.

This removed area or notch 48 forms an enlarged void area 56 at the upper portion of the cylinder bore 12 into which the carbon particles 54 can be pushed by the outer edge 40 of the uppermost piston ring 30 before such carbon particles 54 fuse into a solid mass. The void area 56 can vary between 0.010 to 0.020 inches in the thickness over its length, for example. Even if the solid carbon particles 54 fuse into a solid mass in the lower portion of the recess 48, the particles 54 do not contact the outer edge 40 upper piston ring 30 thereby maintaining the uppermost edge 40 of the piston 30 in a sharp, well-defined shape which minimizes expansion of the uppermost piston ring 30 and minimizes the carbon blowby.

Figure 6:
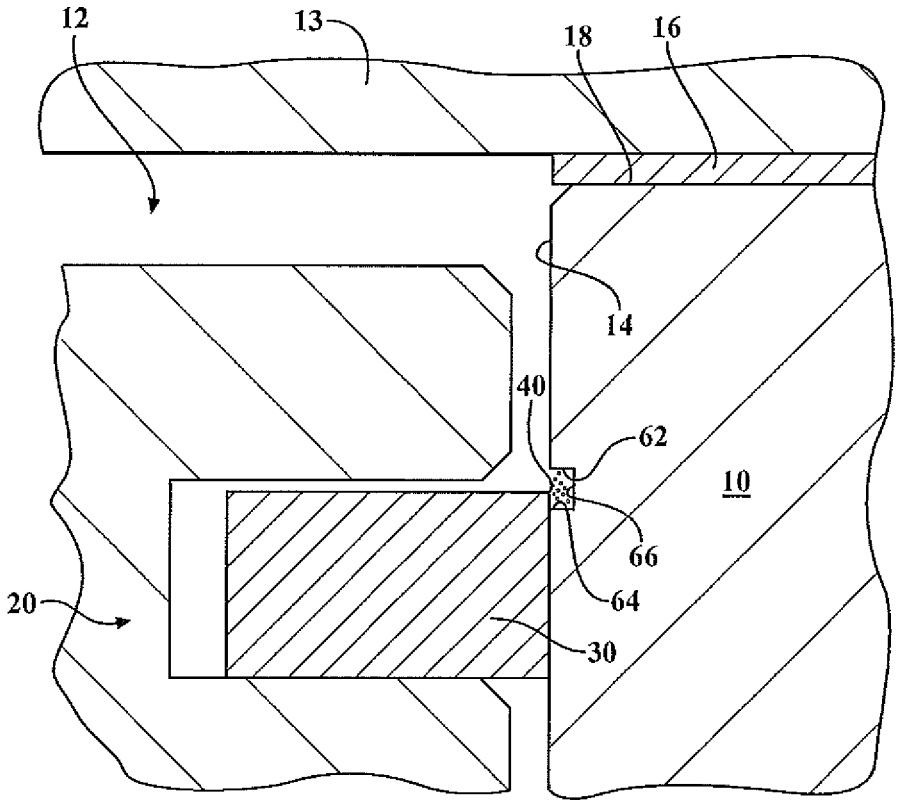
FIG. 6 is a partial, enlarged, side elevational view showing an alternate cylinder wall recess configuration.

Another aspect of the removed area of the cylinder wall 14 is shown in FIG. 6. In this aspect, the removed area is in the form of a groove 60 which may have any shape. By way of example only, the groove 60 is depicted as having first and second sidewalls 62 and 64 extending angularly from the inner surface of the cylinder wall 14, which are joined by an inner wall 66. An open end opposes the inner wall 66 and is located on the inner surface of the cylinder bore.

The uppermost piston ring 30 will scrape any carbon particles 54 which may accumulate on the cylinder wall 14 into the groove 60 during upward movement of the piston 20 within the cylinder bore 12 so as to prevent substantial contact between the carbon particles and the upper outer edge 40 of the piston ring 30 thereby maintaining the upper outer edge 40 in a sharp well defined shape without substantial wear.

What is claimed is:

1. A cylinder block for an internal combustion engine comprising:

cylinder bores, each with an inner wall formed in a cylinder block for containing a piston, each piston having an upper piston ring carried a spaced manner below a top surface of the piston;

a removed area formed in the inner wall of the cylinder block forming each cylinder bore having a lower edge located below a top position of the upper piston ring when the piston is at an uppermost position of an upward stroke within the cylinder bore and partially defining a void space having a greater diameter than a diameter of the inner wall of the cylinder bore; and the void space arranged to receive engine combustion particles scraped from the cylinder bore wall by the upper piston ring to prevent buildup of the engine combustion particles on the inner wall of the cylinder bore in the line of movement of an upper outer edge of the upper piston ring.

2. The cylinder block of claim 1 wherein:

the removed area defines a recess extending from a top surface of the cylinder block into the cylinder bore to the lower edge.

3. The cylinder block of claim 1 wherein:

the removed area is a conical recess decreasing in diameter from the top surface of the cylinder block.

4. The cylinder block of claim 3 wherein:

the recess has a greater diameter at the top surface of the cylinder bore than a diameter of the lower edge of the recess.

5. The cylinder block of claim 1 wherein:

the removed area defines a recess with an upper edge spaced below the top surface of the cylinder block.

6. The cylinder block of claim 5 wherein:

the removed area is a groove in the cylinder block extending radially outward from the cylinder wall.

7. An internal combustion engine comprising:

an engine block with cylinder bores, each cylinder bore having an inner cylinder wall extending from a top surface of the engine block;

a piston reciprocally disposed within each cylinder bore, each piston having an outer wall with the diameter less than a diameter of the inner wall of the corresponding cylinder bore on which the piston is disposed:

at least one piston ring carried on each piston and extending outward from the outer wall of the piston into contact with the cylinder wall;

a removed area in the inner wall having a lower edge, the lower edge of the removed area is located at least no lower from the top surface of the cylinder block than the top position of the upper piston ring when the piston is at an uppermost position of an upward stroke within the cylinder bore and defining, in part, a void space of a greater diameter than a diameter of the inner wall of the cylinger bore; and the void space arranged to receive engine combustion particles scraped from the inner cylinder wall by the piston ring to prevent buildup of the particles on the inner cylinder wall in the line of movement of an upper outer edge of the piston ring.

* * * * *